US007097711B1

(12) United States Patent
Abe et al.

(10) Patent No.: US 7,097,711 B1
(45) Date of Patent: Aug. 29, 2006

(54) ELECTROSTATIC FLOCKING CHAMBER FOR FORMING ELECTROSTATIC FLOCKING APPARATUS

(75) Inventors: Masaaki Abe, Tokyo (JP); Teruyuki Tatsumi, Tokyo (JP)

(73) Assignees: Mesac Corporation, Tokyo (JP); Sumitomo Corporation, Osaka (JP)

( * ) Notice: Subject to any disclaimer, the term of this patent is extended or adjusted under 35 U.S.C. 154(b) by 247 days.

(21) Appl. No.: 09/642,643

(22) Filed: Aug. 22, 2000

(30) Foreign Application Priority Data

Aug. 23, 1999 (JP) ..... 11-235033

(51) Int. Cl.
*B05B 5/14* (2006.01)

(52) U.S. Cl. ..... 118/621; 118/627; 118/640; 118/62; 118/65; 118/72

(58) Field of Classification Search ..... 118/621, 118/627, 640, 50, 50.1, 58, 62, 65, 68, 67, 118/72; 427/482, 462, 463, 464, 465, 200, 427/206, 207.1, 208.2, 208.4, 208.6, 208.8, 427/299, 532, 444, 315; 156/72
See application file for complete search history.

(56) References Cited

U.S. PATENT DOCUMENTS 4,135,962 A * 1/1979 Sinclair et al. ..... 118/224
4,879,969 A * 11/1989 Haranoya et al. ..... 118/638
4,899,411 A * 2/1990 Johnson et al. ..... 12/142 R
6,153,267 A * 11/2000 Horinka et al. ..... 427/475

FOREIGN PATENT DOCUMENTS

EP 787533 * 8/1997

* cited by examiner

*Primary Examiner*—George Koch
(74) *Attorney, Agent, or Firm*—Rader, Fishman & Grauer PLLC

(57) ABSTRACT

An electrostatic flocking operation of a workpiece (5) is advantageously performed in a condition in which the moisture content of an adhesive layer formed on a surface of the workpiece (5) is kept at a favorable value by a humidifier (1). The humidifier (1) is provided between an electrostatic flocking chamber and an adhesive applicator which is disposed in the upstream side of the electrostatic flocking chamber. In the humidifier (1), a current of a moisture bearing air (2) is driven upon the adhesive layer of the workpiece (5).

1 Claim, 1 Drawing Sheet

ELECTROSTATIC FLOCKING CHAMBER FOR FORMING ELECTROSTATIC FLOCKING APPARATUS

BACKGROUND OF THE INVENTION

1. Field of the Invention

The present invention relates to an electrostatic flocking apparatus for electrostatically applying flock to a piece of work having an adhesive layer formed thereon (hereinafter referred to as the workpiece) when the workpiece is passed through an electrostatic flocking chamber at high speed in a condition in which the workpiece is electrically grounded, so that a so-called "electrostatic flocking process" is conducted, wherein the flocking process is followed by a drying process serving as an after treatment as is in ordinary process conducted to produce a flocked product.

2. Description of the Related Art

An electrostatic flocking apparatus has an essential construction in which: a flocking electrode for creating a high voltage electrostatic field is supported inside a housing through an insulation member, wherein the housing forms an electrostatic flocking chamber; a workpiece is oppositely disposed from, i.e., space a certain distance apart from the flocking electrode, and electrically grounded in a condition in which the workpiece is coated with an adhesive layer and disposed either above or below the flocking electrode, or disposed in the same plane or level as that of the flocking electrode; the electrostatic field is created between the flocking electrode and the workpiece, so that short fibers or fibrils are electrostatically floated and driven to fly parallel to the electric lines of force in the electric field toward the workpiece, whereby the short fibers are implanted in the adhesive layer of the workpiece. Then, the workpiece is subjected to an after treatment through which the workpiece is dried to become a flocked product. In fabrication, it is not unusual for the workpiece to be electrically grounded when the workpiece is supported on a shelf or suspended from an appropriate suspension member, provided both the shelf and the suspension member are electrically grounded. Further, it is also not unusual for the workpiece to be moved from an inlet opening of the housing to its outlet opening in a condition in which any supporting member for supporting the workpiece is used.

Provided in a ceiling portion of the housing is a ventilating apparatus provided with a filter, which filter prevents the floating short fibers from escaping outside from the housing in the electrostatic flocking operation.

Disposed on the side of the inlet opening of the housing is an adhesive applicator apparatus for applying an adhesive to a surface of the workpiece to form an adhesive layer thereon, through the adhesive applicator apparatus the workpiece is introduced into the housing.

Disposed on the side of the outlet opening of the housing is a drying apparatus for drying the flocked workpiece to perform an after treatment thereof when the flocked workpiece passes through the drying apparatus.

The drying apparatus is provided with: a heating unit for drying the adhesive layer having been formed on the surface of the workpiece; and, an exhaust port for discharging vapors or moisture contained in the adhesive layer of the flocked workpiece.

The drying apparatus is followed by a product receiving apparatus which receives the flocked products.

Now, the electrostatic flocking operation of the workpiece performed in a conventional electrostatic flocking apparatus will be described using a system called "up-system" as an example, in which up-system a short fiber reservoir portion is disposed below the housing.

The so-called "workpiece" is prepared by the use of the adhesive applicator apparatus disposed in front of the inlet opening of the housing, in which applicator apparatus an adhesive is applied to the surface of a piece of work being electrostatically flocked, so that an adhesive layer is formed on the work, whereby the work having been coated with the adhesive layer, i.e., the so-called "workpiece" is prepared.

The thus prepared workpiece having the adhesive layer formed thereon is supported by a member having been electrically grounded, introduced into the housing through the inlet opening thereof, and disposed inside the housing. In other words, the workpiece is disposed inside the housing in a condition in which the workpiece is electrically grounded.

At this time, a high-voltage is applied to the flocking electrode so that a high voltage electrostatic field is created. Consequently, due to the presence of this electrostatic field, electric lines of force extend from the flocking electrode to the electrically grounded workpiece.

A moisture bearing air is blown from the outside into the reservoir portion so that the short fibers having been stored in the reservoir portion are floated in the electrostatic field. Due to this, the short fibers thus floated in the housing are electrically charged and therefore strongly driven to rush for the workpiece. As a result, the short fibers have their front end portions stuck into the adhesive layer having been applied to the surface of the workpiece, so that the entire surface of the adhesive layer is uniformly covered with the short fibers.

Floating short fibers, which are left over to form excess fibers, reach the ceiling portion of the housing, and are trapped in a filter disposed in the ceiling portion of the housing, while the moisture bearing air is discharged to the outside through an exhaust unit.

The workpiece having subjected to the above operations emerges from the housing through its outlet opening, and then passed through the drying apparatus provided with the heating unit so that the moisture contained in the adhesive of the adhesive layer is evaporated, whereby the short fibers thus stuck in the adhesive layer are firmly implanted in the workpiece in this state.

After completion of the above process, the workpieces (i.e., completed products) are collected.

Consequently, in order to apply flock to the workpiece in the housing, it is necessary for the adhesive layer formed on the surface of the workpiece to have an appropriate viscosity which enables the front end portions of the short fibers (flock) to easily stick into the adhesive layer, wherein the short fibers always fly from the electrode to the workpiece in the housing. In other words, it is necessary for the adhesive layer to be always wet so as to keep its appropriate viscosity described above.

However, the interior of the housing is often heated to increase in temperature when the flocking operation is performed in the housing. Due to this, the moisture in the adhesive layer formed on the workpiece tends to evaporate. Such evaporation of the moisture results in formation of a stressed skin on the adhesive layer, which makes it difficult for the front end portions of the short fibers to stick into the adhesive layer. Consequently, under such circumstances, it is impossible to obtain good quality flocked product even when the workpiece is subjected to the electrostatic flocking operation.

Further, the short fibers floating in the housing tend to escape out of the housing through its inlet and its outlet opening under the influence of the air blown during the electrostatic flocking operation. This is one of disadvantages of the conventional housing. In order to prevent the short fibers from escaping out of the housing through its inlet and its outlet opening, an air curtain unit is provided in each of the inlet and the outlet opening of the housing.

However, heretofore, there is no idea that a suitable device for surmounting the above disadvantage should be provided in the housing. More specifically, there is no idea that such device should be realized by modifying the air curtain unit in a manner such that the air curtain unit also serves as the above device.

SUMMARY OF THE INVENTION

It is an object of the present invention to surmount the above disadvantage by providing an apparatus capable of preventing short fibers from being blown out of a housing, wherein: in an electrostatic flocking process of a workpiece, the short fibers are floated in the housing; and, in order to ensure that the workiece is flocked in its optimum condition, the interior of the housing keeps its moisture content in a manner such that an adhesive layer covering the workpiece supplied into the housing is kept in its optimum wet condition without forming any skin on the surface of the adhesive layer.

The above object of the present invention is accomplished by providing:

An electrostatic flocking apparatus, comprising a humidifier which: assumes a boxy shape; arranged between an electrostatic flocking chamber and an adhesive applicator in a manner such that the humidifier has its inlet and its outlet opening oriented toward an outlet opening of the adhesive applicator and an inlet opening of the electrostatic flocking chamber, respectively; and, is filled with a moisture bearing air supplied from an air blower opening of the humidifier, wherein a workpiece having its surface covered with an adhesive layer of an adhesive supplied from the adhesive applicator travels through the humidifier filled with the moisture bearing air, wherein the moisture air is blown from an outlet opening of the humidifier toward both the inlet and the outlet opening of the humidifier to permit the workpiece to be subjected to the moisture bearing air.

The electrostatic flocking apparatus having the above construction may enjoy the following effect: namely, the humidifier is disposed between the inlet opening of the housing and the adhesive applicator; the workiece passes through the humidifier to have its adhesive layer kept in a desired wet condition, and then enters the housing, so that the workpiece is subjected to the flocking operation when passing through the housing, which makes it possible to have the workpiece subjected to the flocking operation in its preferable flocking condition; and, further, the moisture bearing air blown from the humidifier is directed toward both the inlet and the outlet opening of the housing. Consequently, the above construction of the present invention makes it possible for the moisture bearing air to serve as an air curtain in each of the inlet and the outlet opening of the housing.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

Figure 1:
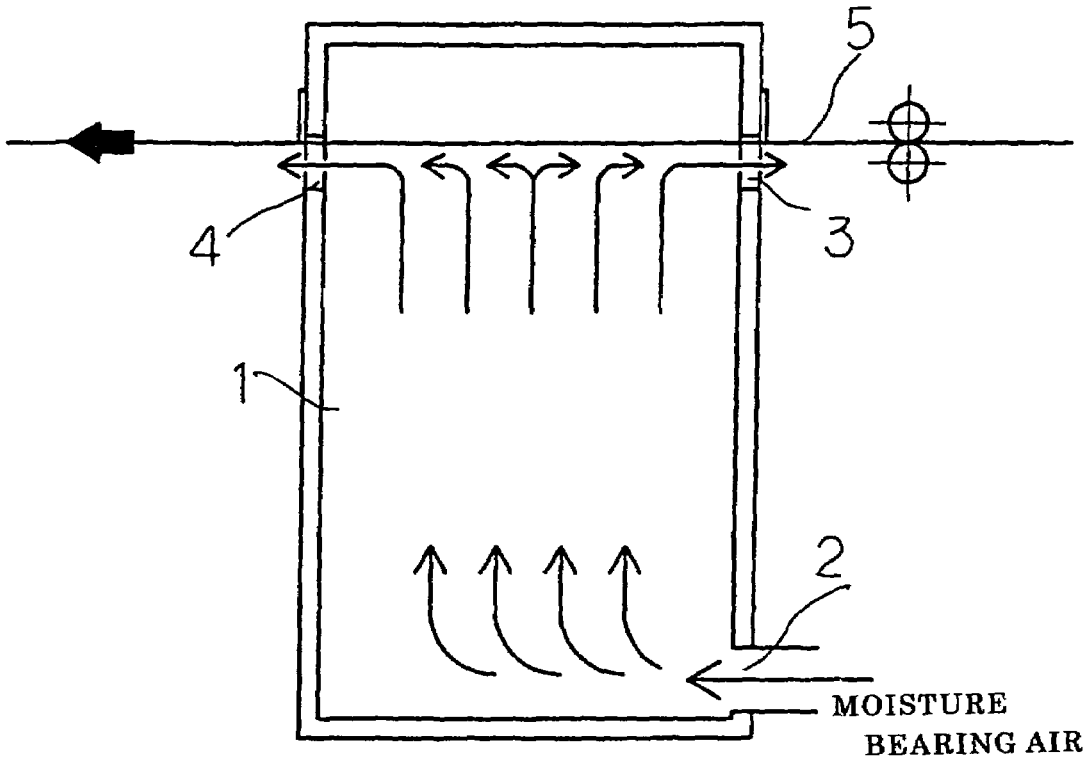
FIG. 1 is a longitudinal sectional view of the humidifier which is disposed between the housing and the adhesive applicator, and has its outlet and its inlet opening oriented toward the inlet opening of the housing and the outlet opening of the adhesive applicator.

The best modes for carrying out the present invention will be described in detail using embodiments of the present invention with reference to the accompanying drawings.

The present invention may, however, be embodied in various different forms and should not be construed as limited to the embodiments set forth herein; rather, these embodiments are provided so that this disclosure will be thorough and complete, and will fully convey the scope of the present invention to those skilled in the art.

An adhesive applicator (not shown) forms an adhesive layer on a surface of a workpiece 5 by applying an adhesive to the surface of the workpiece 5. This workpiece 5 is subjected to an electrostatic flocking process. The adhesive applicator is disposed in front of a housing (not shown) which forms an electrostatic flocking chamber in an electrostatic flocking apparatus of the present invention.

A humidifier 1 of the present invention is disposed between the adhesive applicator and the housing (not shown) in a manner such that the humidifier 1 has its inlet opening 3 and its outlet opening 4 oriented toward an outlet opening of the adhesive applicator (not shown) and an inlet opening of the housing, respectively.

The humidifier 1 has a boxy construction into which the moisture bearing air is blown through an moisture-bearing air blower opening 2 from a moisture-bearing air supply apparatus (not shown) which is provided with a steam generator (not shown). In other words, the humidifier has a construction in which: the humidifier is filled with the moisture bearing air blown therein; and, the moisture bearing air filled in the humidifier is delivered through the outlet opening 4 to the inlet opening of the housing.

The workpiece 5, which is a flat plate assuming a strip-like elongated shape and is coated with the adhesive layer, enters the humidifier 1 through its inlet opening 3, travels through the humidifier 1, and leaves the humidifier 1 through its outlet opening 4. Now, the above construction will be described in detail, as an illustrative example.

In operation, the workpiece 5 is supplied from the adhesive applicator to the housing. The thus supplied workpiece 5 enters the humidifier 1 through its inlet opening 3, passes through the interior of the humidifier 1, and leaves the humidifier 1 through its outlet opening 4. In the above process, the workpiece 5 has its adhesive layer evenly subjected to the moisture bearing air filled in the humidifier 1, wherein the moisture bearing air is supplied from the moisture-bearing air supply apparatus (not shown) through the air blower opening 2 to the interior of the humidifier 1, whereby the adhesive layer of the workpiece is evenly wetted.

The workpiece 5 thus evenly wetted in the above process leaves the humidifier 1 through its outlet opening 4 to enter the housing through its inlet opening, and then passes through the interior of the housing. When the workpiece 5 passes through the housing, the moisture content of the adhesive layer of the workpiece 5 is sufficiently increased. This makes it possible for the short fibers to have their front end portions stick in the adhesive layer without fail. As a result, it is possible to supply a good flocked product through the outlet opening of the housing.

More specifically, in the humidifier 1 of the present invention having the above construction: the moisture bearing air is filled in the humidifier 1; the moisture bearing air thus filled in the humidifier 1 functions to increase the moisture content of the adhesive layer of the workpiece 5 when the workpiece 5 passes through the humidifier 1. At this time, the moisture bearing air filled in the humidifier 1 flows over the humidifier 1 through both the inlet opening 3 and the outlet opening 4 thereof, wherein the amount of the moisture bearing air passing through the outlet opening 4 is larger that that of the moisture bearing air passing through the inlet opening 3.

The outlet opening 4 of the humidifier 1 is disposed closely adjacent to the inlet opening of the housing. Consequently, substantially all the moisture bearing air flowing out of the outlet opening 4 of the humidifier 1 may flow into the housing.

Due to the above phenomenon, the moisture bearing air has flown into the housing functions to prevent the atmosphere of the interior of the housing from drying. Consequently, it is possible for the humidifier 1 of the present invention to realize the optimum atmosphere of the housing in the electrostatic flocking operation by controlling the flow rate of the moisture bearing air being supplied to the humidifier 1. At this time, it is also possible for the humidifier 1 to prevent the floating short fibers from flying to the outside from the inlet opening of the housing.

In other words, the humidifier 1 also functions to provide an air curtain in the inlet opening of the housing.

Further, the air blower's mechanism of the moisture-bearing air supply apparatus is oriented not only toward the inlet opening of the housing, but also toward the outlet opening of the housing so as to serve as a circuit for controlling the amount of the moisture-bearing air being supplied. In the above condition: the moisture bearing air thus controlled is then supplied to the housing as a moisture bearing air for increasing the moisture content of the atmosphere of the housing. Further, the moisture bearing air having been blown into the housing functions: to prevent the interior of the housing from drying; and, to prevent the short fibers floating in the housing from flying out of the housing through its outlet opening.

In other words, the above construction of the present invention functions to provide an air curtain in the outlet opening of the housing.

Finally, the present application claims the Convention Priority based on Japanese Patent Application No. Hei 11-235033 filed on Aug. 23, 1999, which is herein incorporated by reference.

What is claimed is:

1. An electrostatic flocking apparatus comprising: an electrostatic flocking chamber; an air curtain unit having a boxy shape; and, an adhesive applicator, wherein an electrostatic flocking operation is performed inside the chamber and the air curtain unit functions to prevent short fibers floating inside the chamber from escaping out of the apparatus, characterized in that the air curtain unit is: disposed closely adjacent to an inlet opening of said chamber and serving as a humidifier (1); arranged between the chamber and the adhesive applicator to have its inlet opening (3) and its outlet opening (4) in communication with an outlet opening of the adhesive applicator and the inlet opening of the chamber, respectively, without any interruption in communication with each of the adhesive applicator and the chamber during the electrostatic flocking operation; and, filled with a moisture bearing air (2) supplied from an air blower opening (2) of the humidifier (1), wherein an elongated workpiece strip (5) having its surface covered with an adhesive layer of an adhesive continuously conveyed from the adhesive applicator travels through the humidifier (1) at a time when the electrostatic flocking operation is performed in the chamber, to enter said chamber during the flocking operation so as to be continuously subjected to the electrostatic flocking operation in the chamber; wherein the moisture bearing air is blown from the blower opening of the humidifier (1) to both the inlet opening (3) and the outlet opening (4) of the humidifier (1) to permit the workpiece strip (5) to be subjected to the moisture bearing air (2) and thus keeping the adhesive layer of said workpiece strip (5) wet in viscosity so as to enable said short fibers to easily stick into the adhesive layer, the moisture bearing air passing through the inlet opening (3) and the outlet opening (4) with a first amount of the moisture bearing air passing through the inlet opening (3) and a second amount of moisture bearing air passing through the outlet opening (4), the second amount of moisture bearing air being larger than the first amount of moisture bearing air, wherein the moisture bearing air (2) which is filled in the humidifier but still not brought into contact with the adhesive layer of said workpiece strip (5) is much higher in moisture content than the moisture bearing air which is filled in the chamber to moisturize the fibers.

* * * * *